US005638899A

United States Patent [19]

Blomgren et al.

[11] Patent Number: 5,638,899

[45] Date of Patent: Jun. 17, 1997

[54] WELDED PLATE HEAT EXCHANGER

[75] Inventors: Ralf Blomgren, Skanor; Jarl Andersson; Mats Nilsson, both of Lund, all of Sweden

[73] Assignee: Alfa-Laval Thermal AB, Lund, Sweden

[21] Appl. No.: 256,439

[22] PCT Filed: Jan. 22, 1993

[86] PCT No.: PCT/SE93/00042

§ 371 Date: Mar. 28, 1996

§ 102(e) Date: Mar. 28, 1996

[87] PCT Pub. No.: WO93/15369

PCT Pub. Date: Aug. 5, 1993

[30] Foreign Application Priority Data

Jan. 27, 1992 [SE] Sweden ..... 9200213

[51] Int. Cl.[6] ..... F28D 9/00

[52] U.S. Cl. ..... 165/166; 165/167; 165/DIG. 384

[58] Field of Search ..... 165/166, 167, 165/DIG. 373, DIG. 382, DIG. 384

[56] References Cited

U.S. PATENT DOCUMENTS

| | | | |
|---|---|---|---|
| 4,723,601 | 2/1988 | Ohara et al. | 165/153 |
| 5,125,453 | 6/1992 | Bertrand et al. | 165/153 |
| 5,327,958 | 7/1994 | Machata et al. | 165/167 |

FOREIGN PATENT DOCUMENTS

| | | | |
|---|---|---|---|
| 611941 | 8/1994 | European Pat. Off. | 165/167 |
| 60-216184 | 10/1985 | Japan | 165/167 |
| 61-83883 | 4/1986 | Japan | 165/166 |
| 8400086 | 8/1985 | Netherlands | 165/166 |

*Primary Examiner*—Allen J. Flanigan

*Attorney, Agent, or Firm*—Fish & Richardson P.C.

[57] ABSTRACT

In a welded plate heat exchanger the edge portion of each heat transferring plate (2) is welded together with the edge portions of a first adjacent heat transferring plate (3) along an outer line (10B) and with the edge portion of a second adjacent heat transferring plate (1) along an inner line (11B). In order to ensure, in connection with welding together of the heat transferring plates from only one direction, that contact is maintained between the plates along said outer line (10B) each heat transferring plate is formed with a stiffening crease (18) outside said outer line. The stiffening crease (18) extends along the edge of plate outside said outer line (10B).

7 Claims, 2 Drawing Sheets

WELDED PLATE HEAT EXCHANGER

Figure 1:
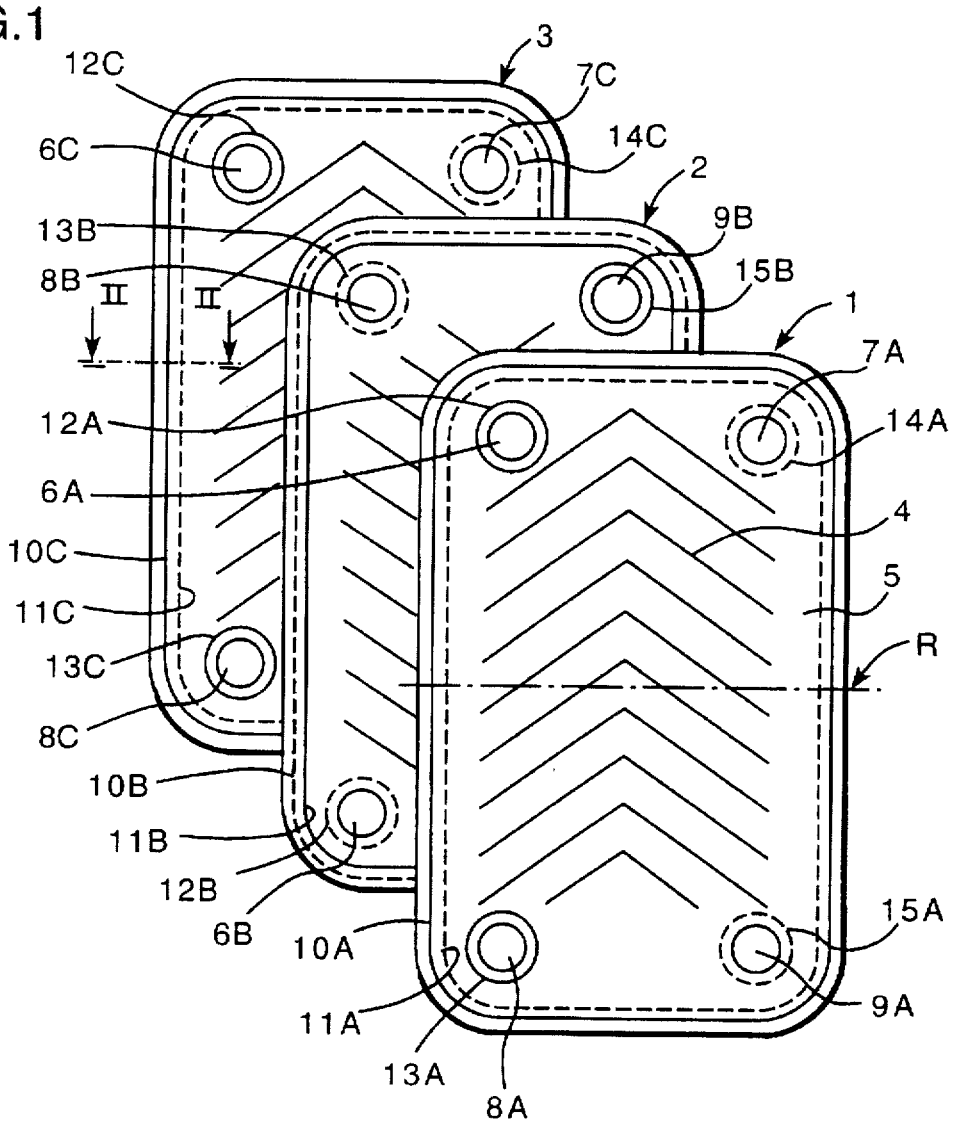

The present invention relates to a plate heat exchanger comprising a stack of thin heat transferring plates each of which has a central heat transferring portion provided with a pressed pattern of spacing protuberances and depressions and an edge portion extending along the edge of the heat transferring plate and surrounding said heat transferring portion, a first heat transferring plate, that is situated between two other heat transferring plates in the stack, being welded by its edge portion together with the edge portion of one of said two other heat transferring plates along an outer line and being welded together with the edge portion of the other one of said two other heat transferring plates along an inner line which is situated inside said outer line, and the edge portions of the heat transferring plates extending into contact with each other along said inner and outer lines.

A plate heat exchanger of this kind, known for instance by GB 580 368, may be manufactured by first welding together heat transferring plates in pairs along the respective said inner lines and, thereafter, welding together already united plate pairs along the respective said outer lines. A plate heat exchanger constructed in a different but alternative way is known by GB-A-2 126 703.

Conventional welding technique normally requires in connection with welding together of two plates that welding tools are put into contact with both of the plates. Modern welding technique, however, such as laser welding and electronic beam welding, makes it possible to weld together two superimposed plates by use of a welding tool only on one side of the two plates. An advantage of modern welding techniques also is that less heat has to be generated in the plates to be welded together.

By means of modern welding techniques it would thus be possible in connection with welding together of several heat transferring plates to stack the plates successively onto each other and successively weld them together by applying a welding tool only from one direction. Preferably, the first plate is placed on a horizontal support, whereafter the other plates one after one are superimposed and welded onto the underlying plate.

Possibly, modern welding technique will make it possible in the future also to weld together simultaneously several plates stacked on each other by use of welding tools only on one side of the plate stack.

However, in connection with attempts to manufacture welded plate heat exchangers of the initially defined kind by use of welding tools only on one side of the heat transferring plates to be welded together it has proved difficult to accomplish completely perfect welding joints between the plates, above all along the above mentioned outer lines. One reason for this is the difficulty of keeping, during a welding operation, the outermost edge portions of two adjacent heat transferring plates effectively pressed against each other, so that a good contact is obtained between the plates. Thus, it has not been sufficient for obtaining such a good contact, when one heat transferring plate has been superimposed onto another, to apply a compressing pressure in the area of the central heat transferring portions of the plates.

A complication in this connection is that the material in the heat transferring plates is expanded locally during the welding operation by the heat generated around the place of welding and that, as a consequence thereof, the edge portions of the plates lose contact with each other. As the point of welding is moved along the plate edge portions a gap—coming up in this way between the plates—has proved to grow, and the result of this has been that the material in the plate edge portions, instead of being united, has melted here and there and left through holes in the edge portions. (See the accompnaying drawing FIG. 6.)

For avoiding contact problems of this kind also the outermost edge portions of two plates to be welded together along their edge portions have to be kept very heavily together by means of a fixture of some suitable kind.

However, application of a fixture at the edge portions every time a new heat transferring plate is to be welded onto a stack of previously welded together heat transferring plates will become an expensive and a time consuming operation, which heavily reduces Or makes impossible an economic benefit of using modern welding technique.

The object of the present invention is to provide a solution of the above discussed problem, so that even the outermost edge portions of two adjacent heat transferring plates may be kept together in a simple and effective way while these edge portions are welded together, e.g. by application of a force only in the area of the central heat transferring portions of the plates.

According to the invention a very simple solution of this problem in connection with a plate heat exchanger of the initially defined kind is that the edge portion of each heat transferring plate extends a distance outside said outer line and in the area outside the outer line is formed with a stiffening crease extending along the outer line.

It has proved, thus, that if each heat transferring plate has been formed with such a stiffening crease before the welding operation there will be no or only a very small gap of the kind described above coming up in connection with the welding. The stiffening crease thus appears to eliminate the gap or in any case limit the size of the gap so much that the gap will not jeopardize the forming of a perfect continuous welding joint.

In a comparison between a plate heat exchanger formed according to the invention and a plate heat exchanger formed in the way to be seen from GB 580 368 it is evident that the invention has not only added the formation of the above said stiffening crease but has also meant that each heat transferring plate has been provided with a further edge portion outside said outer line for the formation of said crease.

Within the scope of the invention every second, but preferably each, heat transferring plate may have on its one side a first ridge extending along said edge portion at a distance from the edge of the heat transferring plate, and on its other side a second ridge extending along the edge portion inside of the first ridge, the heat transferring plate on its said one side being connected by welding with an adjacent heat transferring plate at and along the crest of said first ridge, and on its said other side by welding being connected with another adjacent heat transferring plate at and along the crest of said second ridge.

In a preferred embodiment of a plate heat exchanger according to the invention the edge portions of the heat transferring plates, outside the respective outer lines, are formed such, that in the plate interspaces between those plates being welded together along said inner lines the edge portions of these adjacent plates abut against each other at least along parts of the edge portions, whereas abutment of this kind is substantially non-existent between the edge portions in the rest of the plate interspaces outside said outer lines. Hereby, a further improvement may be achieved of the preconditions for a good contact between the edge portions of the plates along the said outer lines during the welding operation.

The invention is described more in detail in the following with reference to the accompanying drawing, in which FIG. 1 schematically shows three heat transferring plates arranged as in a plate heat exchanger but separate from each other.

Figure 4:
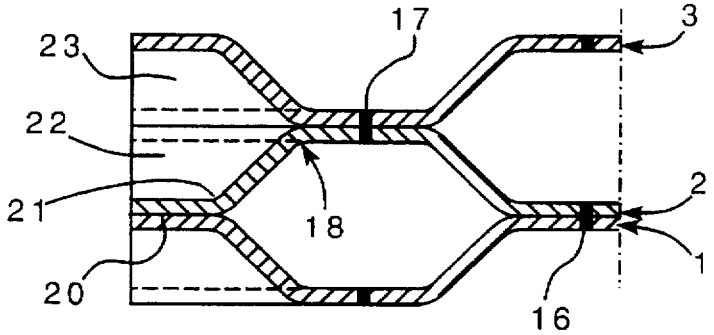
Figure 5:
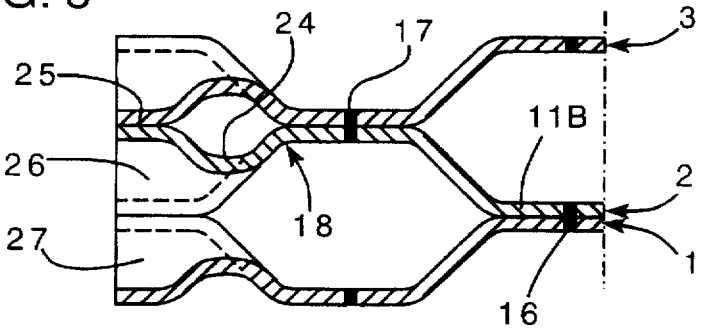
Figure 6:
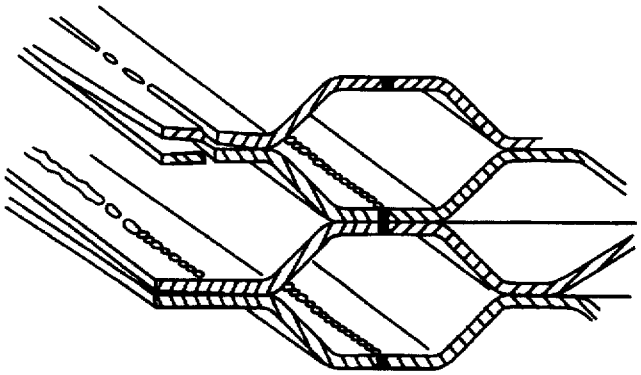

FIGS. 2–5 show in cross section different embodiments, according to the invention, of the edge portions of the plates in FIG. 1, and FIG. 6 illustrates how the edge portions of a number of heat transferring plates may be damaged in connection with a welding operation if they are not formed in accordance with the present invention.

FIG. 1 shows three rectangular elongated heat transferring plates 1, 2 and 3. All of the plates are identically formed but oriented in different ways. Thus, the plates 1 and 3 are turned in the same direction, whereas the plate 2 is turned 180° around its horizontal centre line relative to the plates 1 and 3. In FIG. 1 the horizontal centre line of the plate 1 is designated R.

The heat transferring plates consist of thin metal sheet which by pressing has been provided with a corrugation pattern of ridges and walleys in their central heat transferring portions 4. The corrugation pattern is like herring bones and is formed such that ridges of adjacent plates will cross and abut against each other when several plates are stacked upon each other in the way illustrated in FIG. 1.

Each heat transferring plate has an edge portion 5 surrounding the heat transferring portion 4. In the corners of the heat transferring portion each plate has four through holes or ports. In FIG. 1 these are designated 6, 7, 8 and 9 followed by the letters A, B and C for the respective plates 1, 2 and 3.

Along the edge portion of the plate 1, around the whole plate, there is extending a ridge 10A, which is pressed to the same height as the ridges in the heat transferring portion 4 or possibly somewhat higher. The ridge 10A forms on the opposite side of the plate 1 a groove which thus also extends around the whole of the plate. The corresponding groove of the plate 2 is shown by a dotted line 10B.

Immediately inside of the ridge 10A the plate 1 has a depressed groove 11A, which is shown by a dotted line and extends along the edge portion of the plate around the whole of the plate. This groove 11A forms on the opposite side of the plate 1 a ridge which has a counterpart in the plate 2, shown by a full line 11B. Alternatively, the groove 11A in the areas of the ports 7A and 9A could have extended between the heat transferring portion 4 and the respective ports 7A and 9A instead of extending along the edge portion outside these ports.

The plate 1 around each of the ports 6A and 8A has an annular ridge 12A and 13A, respectively. The ridges around the ports 6A and 8A forms on the opposite side of the plate 1 annular grooves, the counterparts of in the plate 2 are shown by dotted lines 12B and 13B, respectively. Furthermore, the plate 1 around each the ports 7A and 9A has a depressed annular groove 14A and 15A, respectively, which grooves on the opposite side of the plate form annular ridges. A corresponding such annular ridge of the plate 2 is shown by a full line 15B around the port 9B.

As previously said, the plate 3 is oriented in the same way as the plate 1. The same reference numerals as for the various parts of the plate 1, therefore, have been used for the corresponding parts of the plate 3; however followed by the letter C instead of A.

When the plates 1, 2 and 3 are pressed together in a plate package, the ridges in the heat transferring portions 4 of adjacent plates, as mentioned before, will cross and abut against each other in the two formed plate interspaces. Furthermore, the annular ridge 15B around the port 9B of the plate 2 will come to abutment—crest against crest—against the annular ridge formed by the groove 14A of the plate 1. A corresponding abutment between the plates 1 and 2 will be obtained around the port 9A of the plate 1 and the opposite port (not shown) of the plate 2. There will be no corresponding abutment, however, around the ports 6A, 8B and 8A, 6B of the plates 1 and 2.

In the interspace between the plates 2 and 3 there will be obtained a corresponding abutment between the plates around the ports 8B, 6C and 6B, 8C, whereas no abutment will be obtained between the plates around the ports 9B, 7C and the two other ports (not Shown) of the respective plates 2 and 3.

Along the plate edge portions the ridge 11B of the plate 2 will abut against the ridge of the plate 1 formed by the groove 11A in the latter. Furthermore, the ridge 10C of the plate 3 will abut against the ridge of the plate 2 formed by the groove 10B of the latter.

When the plates 1, 2 and 3 are welded together along the lines along which they abut against each other, there will come up between the plates 1 and 2 an interspace—or a flow space—which is delimited by a weld joint formed along an inner edge line having the same extension as the ridge 11B of the plate 2. This flow space communicates with the ports 6B, 8A and 8B, 6A of the respective plates 1 and 2 but is closed from communication with the other ports of the same plates. Between the plates 2 and 3 there is formed another plate interspace—or flow space—which is delimited by a weld joint formed along an outer edge line having the same extension as the groove 10B of the plate 2. This flow space communicates with the ports 9B, 7C of the plates 2 and 3, respectively, and the two ports of these plates which are not shown, but is closed from communication with the ports 9B, 6C and 6B, 8C of the same plates. The two plate interspaces, therefore, do not communicate with each other and are intended to be flowed through by different heat exchange fluids.

Figure 2:
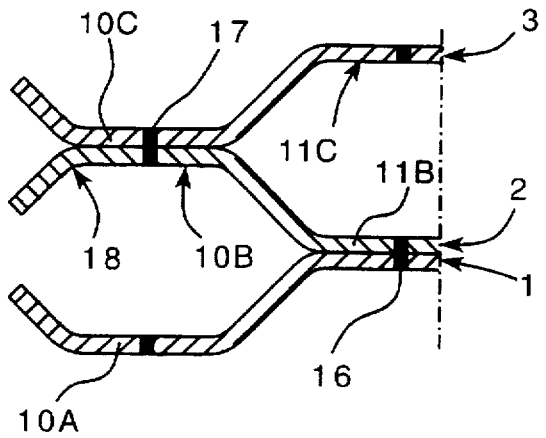

FIG. 2 shows a first embodiment of the edge portions of the plates 1, 2 and 3. The edge portions are shown in a cross section as illustrated by the line II—II at the plate 3 in FIG. 1. The above mentioned welding joint between the edge portions of the plates 1 and 2 is shown at 16, and the welding joint between the edge portions of the plates 2 and 3 is shown at 17.

For the obtainment of a weld joint 17 the edge portions of the plates 2 and 3 could have ended at or immediately outside the predetermined line for the weld joint 17. However, it has proved difficult to obtain perfect weld joints at plates formed in this manner, when several plates are to be stacked upon each other and successively welded together from only one direction. FIG. 6 illustrates a result often obtained. By local heat generation in adjacent plates these have expanded, so that narrow gaps have come up where a weld joint, should be formed. Thereby, instead of a weld joint, through holes have been formed in the plates.

By forming the plate edge portions in a certain way, according to the invention, it has proved possible to avoid such concequences of the inevitable local heating of the plates Thus, each of the plates 1, 2 and 3 in FIG. 2 has been formed with a crease 18 extending continuously along the weld joint 17. Hereby, the plates have become stiffer in the longitudinal direction of the edge portions, whereby conditions have been created for a good contact between adjacent plates in the area where a weld joint 17 is to be formed.

Figure 3:
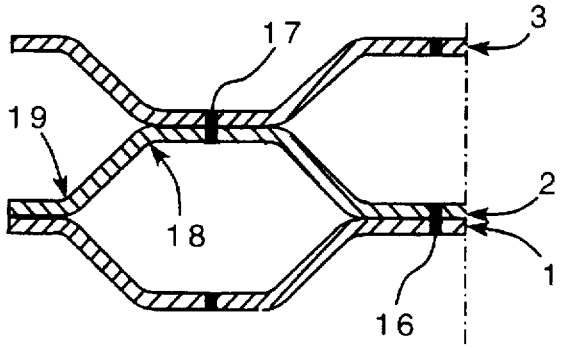

FIG. 3 shows another embodiment of the invention, in which in addition to a crease 18 a further continuous crease 19 has been formed in each plate between the crease 18 and the edge of the plate. As can be seen, in this case the plate 2 extends into contact with the plate 1 outside the weld joint 17. Hereby, it is ensured that when the plate 3 is put upon the plates 1 and 2 already welded together at 16, the outermost edge portion of the plate 2 will be well supported by the edge portion of the plate 1. In other words good conditions have been created for a satisfactory contact between the plates 2 and 3 in the area where the weld joint 17 is to be formed.

Since no contact is foreseen between the edge portions of the plates 2 and 3 outside the crease 18, the risk is avoided that such a contact would jeopardize a good contact between the plates 2 and 3 in the area where the weld joint 17 is to be formed.

FIG. 4 shows a further embodiment of the invention in which the part of each plate situated between the crease 18 and tile edge of the plate has been formed in a different way. With reference to the intermediate plate 2, which is connected with the plate 3 along the weld joint 17, the edge portion of the plate 2 extends into contact with the plate 1 in an area 20 situated between the crease 18 and the edge of the plate 2. A further crease 21, similar to the crease 19 of the embodiment in FIG. 3, is formed between the crease 18 and said area 20.

At sufficiently large intervals along the edge portion of the plate 2 this edge portion, in the area between the crease 18 and the edge of the plate, is provided with local protuberances 22. Corresponding local protuberances 23 are made in the plate 3 opposite to the protuberances 22, so that the plates 2 and 3 abut against each other locally via these protuberances 22 and 23.

Each one of the local protuberances 22 and 23 must have a relatively small extension and, as mentioned, be situated at relatively large intervals along the respective plate edges, so that they will not jeopardize the above described stiffness provided by the crease 18. Upon compressing of a stack of plates the contact between the plates in the areas 20 and via the local protuberances 22 and 23 will give support between all adjacent plates in the whole plate stack at the plate edge portions.

FIG. 5 shows a fourth embodiment of the invention, in which outside a continuous crease 18 in each plate there are formed ridges 24 situated at some distance from and aligned with each other along the plate edge portion. With reference to tile plate 2 the ridges 24 are about half as high as the ridge 11B in the same plate. Outside the ridges 24 the plate 2 abuts against the plate 3 in areas 25.

Between the ridges 24 the plate 2 along the plate edge is provided with protuberances 26 which have the same height as the ridges 11B. Corresponding protuberances 27 are present in the plate 1, situated so that the plates 1 and 2 abut against each other via the protuberances 26 and 27. Also in this embodiment of the invention there is obtained a support between the edge portions of all adjacent plates. In this case, however, the crease 18 extends continuously along the whole of the edge portion of each plate and, therefore, the ridges 24 and the protuberances 26 may be given any desirable lengths along the edge portion.

FIG. 6 illustrates, as has been previously described, undesired effects in connection with welding together of two plates, the edge portions of which have not been formed in accordance with the present invention.

We claim:

1. Plate heat exchanger comprising a stack of thin heat transferring plates, each of which has a central heat transferring portion provided with a press pattern of spacing protuberances and depressions and an edge portion extending along the edge of the heat transferring plate and surrounding said heat transferring portion, a first heat transferring plate, that is situated between two other heat transferring plates in the stack, being welded by its edge portion together with the edge portion of one of said two other heat transferring plates along an outer line and being welded together with the edge portion of the other one of said two other heat transferring plates along an inner line which is situated inside said outer line, and the edge portions of the heat transferring plates extending into contact with each other along said inner and outer lines, wherein the edge portion of each heat transferring plate extends a distance outside said outer line and, in the area outside said outer line, is formed with a stiffening crease extending along said outer line, and further wherein the edge portions of the heat transferring plates, outside the respective outer lines, are formed such that in the plate interspaces between those plates being welded together alone said inner lines, the edge portions of these adjacent plates abut against each other at least along parts of the edge portions.

2. Plate heat exchanger according to claim 1, wherein each heat transferring plate on its one side has a first ridge extending along said edge portion at some distance from the edge of the heat transferring plate and on its other side has a second ridge extending along the edge portion inside said first ridge, and that the heat transferring plate on its said one side is connected by welding with an adjacent heat transferring plate at and along the crest of the first ridge, and on its said other side is connected by welding with another adjacent heat transferring plate at and along the crest of said second ridge.

3. Plate heat exchanger according to claim 1, wherein each of the heat transferring plates in the stack, outside its said outer line, is formed such that the edge portion of said first heat transferring plate abuts alternately against the edge portion of said one and the edge portion of said other one of said two other heat transferring plates, seen along the three edge portions, so that all adjacent heat transferring plates in the stack support each other outside the respective outer lines.

4. Plate heat exchanger according to claim 3, wherein the edge portion of each heat transferring plate outside said outer line has protuberances on one side of the heat transferring plate, distributed along said edge portion, said protuberances abutting against corresponding protuberances of an adjacent heat transferring plate in the stack.

5. Plate heat exchanger according to claim 1, wherein said stiffening crease extends substantially continuously around the heat transferring plate.

6. Plate heat exchanger according to claim 5, wherein each of the heat transferring plates in the stack, outside its substantially continuous stiffening crease, is formed such that the edge portion of said first heat transferring plate abuts alternately against the edge portion of said one and the edge portion of said other one of said two other heat transferring plates, seen along the three edge portions, so that all adjacent heat transferring plates in the stack support each other outside the respective outer lines.

7. Plate heat exchanger according to claim 6, wherein the edge portion of each heat transferring plate, outside its substantially continuous stiffening crease, has protuberances on one side of the heat transferring plate, distributed along said edge portion, said protuberances abutting against corresponding protuberances of an adjacent heat transferring plate in the stack.

* * * * *

UNITED STATES PATENT AND TRADEMARK OFFICE

CERTIFICATE OF CORRECTION

PATENT NO. : 5,638,899

DATED : June 17, 1997

INVENTOR(S) : Blomgren et al.

It is certified that error appears in the above-indentified patent and that said Letters Patent is hereby corrected as shown below:

Col. 2, line 12, replace "Or" with --or--.

Col. 3, line 51, replace "counterparts of" with --counterparts of which--.

Col. 3, line 53, insert --of-- after "each".

Col. 4, line 12, replace "Shown" with --shown--.

Col. 4, line 54, delete "," after --joint--.

Col. 5, line 17, replace "tile" with --the--.

Col. 5, line 45, replace "tile" with --the--.

In the claims:

Col. 6, line 18, change "alone" to --along--.

Signed and Sealed this

Ninth Day of September, 1997

*Attest:*

Bruce Lehman

BRUCE LEHMAN

*Attesting Officer*

*Commissioner of Patents and Trademarks*